US005195547A

United States Patent [19]

Devens

[11] Patent Number: 5,195,547

[45] Date of Patent: Mar. 23, 1993

[54] PRESSURIZED WEIR FOR A FUMELESS PICKLING OR CLEANING SYSTEM

[75] Inventor: Daniel R. Devens, Zelienople, Pa.

[73] Assignee: Allegheny Plastics, Inc., Coraopolis, Pa.

[21] Appl. No.: 786,754

[22] Filed: Nov. 1, 1991

[51] Int. Cl.[5] ..... B08B 3/04

[52] U.S. Cl. ..... 134/114; 134/199; 239/193

[58] Field of Search ..... 134/114, 64 R, 122 R, 134/177; 4/192

[56] References Cited

U.S. PATENT DOCUMENTS

| | | | |
|---|---|---|---|
| 930,926 | 8/1909 | Bentley | 239/193 |
| 1,561,577 | 11/1925 | Trautman | 134/122 R |
| 3,315,896 | 4/1967 | Jacir | 239/193 |
| 3,491,792 | 1/1970 | Eckert | 137/561 |
| 3,882,665 | 5/1975 | Hughes et al. | 57/149 |
| 4,076,222 | 2/1978 | Schaming | 134/122 R |
| 4,355,762 | 10/1982 | Coleman | 239/193 |
| 4,476,069 | 10/1984 | Harper et al. | 239/193 X |
| 4,592,784 | 6/1986 | Ghizzi | 134/15 |
| 4,823,409 | 4/1989 | Gaffney et al. | 4/192 |
| 4,846,202 | 7/1989 | Kallweit | 134/122 R |
| 4,846,603 | 7/1989 | Tsuji et al. | 405/115 |
| 4,886,210 | 12/1989 | Gaffney et al. | 239/193 |
| 4,908,136 | 3/1990 | Chou et al. | 210/661 |
| 4,950,333 | 8/1990 | Hone et al. | 134/15 |
| 4,951,694 | 8/1990 | Hone et al. | 134/64 |
| 5,115,974 | 5/1992 | Tobias et al. | 239/193 X |

FOREIGN PATENT DOCUMENTS

| | | | |
|---|---|---|---|
| 2641802 | 3/1978 | Fed. Rep. of Germany | 239/193 |
| 21882 | 10/1902 | United Kingdom | 239/193 |

*Primary Examiner*—Frankie L. Stinson

*Attorney, Agent, or Firm*—Webb, Burden, Ziesenheim & Webb

[57] ABSTRACT

A pressurized weir for a fumeless pickling or cleaning system includes a pair of housing plates, one plate having an inlet opening for admitting water under pressure to the weir; a reservoir plate and metering plate; means for retaining said reservoir plate and said metering plate between said housing plates; a reservoir provided by said reservoir plate and said metering plate for receiving water under pressure from said inlet opening; and at least one truncated triangular opening in each of said reservoir plate and said metering plate, the bottom of said opening permitting water under pressure to be exhausted from said reservoir in the form of a water curtain. When used in combination with a pickling or cleaning system having a closed cell tank, the pressurized weir contains the fumes from the acid within the tank.

11 Claims, 5 Drawing Sheets

PRESSURIZED WEIR FOR A FUMELESS PICKLING OR CLEANING SYSTEM

BACKGROUND OF THE INVENTION

1. Field of the Invention

This invention relates to weirs and particularly to weirs for pickling and cleaning systems. More particularly, the invention relates to a pressurized weir for use in a closed cell pickling or cleaning system and which provides a water curtain of an adjustable thickness which makes the system essentially fumeless.

2. Description of the Prior Art

Heretofore, the fume problems associated with pickling and cleaning tanks which include acids have been addressed by closing the tanks with covers, utilizing exhaust fans or providing weirs over which water overflows or cascades to prevent fume emissions from escaping the tanks. Prior art gravity weir designs have, however, been characterized by unpredictable, uncontrollable and unreliable overflow and cascading weir designs. Prior weir designs also were characterized by a lack of water curtain uniformity and the presence of a water necking problem which caused the water curtain to have non-uniform thickness and be marked by discontinuities which rendered the curtain pervious to fume exhaust.

SUMMARY OF THE INVENTION

A pressurized weir for a fumeless pickling or cleaning system comprises a pair of housing plates, a reservoir plate and a metering plate. All of the plates are preferably made of solid thermoplastic material and most preferably of polypropylene. The reservoir plate and metering plate are sandwiched between the housing plates and retained therebetween by fastener means, such as bolts, e.g. CPVC bolts.

An inlet opening is provided through one of the housing plates to permit water to be pumped under pressure through the housing plate, into a reservoir formed by the reservoir plate and metering plate and outwardly through an opening in the bottom of the metering plate to form a uniform water curtain.

The housing plates are preferably of generally rectangular shape. The reservoir plate is of substantially the same overall rectangular shape as the housing plates, but it contains at least one truncated triangular cutout or opening which forms a part of the water reservoir in the weir. A plurality of such cutouts or openings may be provided in a reservoir plate.

The metering plate also has substantially the same overall rectangular shape as the housing plates and the reservoir plate and contains one or more truncated triangular openings comparable to those of the reservoir plate, except that the metering plate is open at the bottom to permit water to exit therefrom to form the uniform water curtain. Thus, water directed under pressure into the inlet enters the reservoir provided by the reservoir plate and metering plate, and exits the weir under pressure in a continuous water curtain.

The configuration of the truncated triangular openings which form the weir reservoir reduces turbulence and other flow disturbances including necking usually found in other weirs, avoids undesirable gaps or bubbles in the continuous water curtain and confines fumes in the tank.

The thickness of the reservoir and metering plates are selected to optimize the size of the reservoir and the thickness of the water curtain. The metering plate may be replaced easily by removing the bolts, substituting a thicker or thinner plate and replacing the bolts. By changing the thickness of the metering plate, the thickness of the water curtain can be adjusted easily.

The pressurized weir according to the invention can be provided in combination with new pickling or cleaning systems or sold separately and retrofitted to existing systems.

The invention will be understood and appreciated in light of the following detailed description when taken with the accompanying drawings.

DETAILED DESCRIPTION OF THE DRAWINGS

DETAILED DESCRIPTION OF PREFERRED EMBODIMENTS OF THE INVENTION

Figure 1:
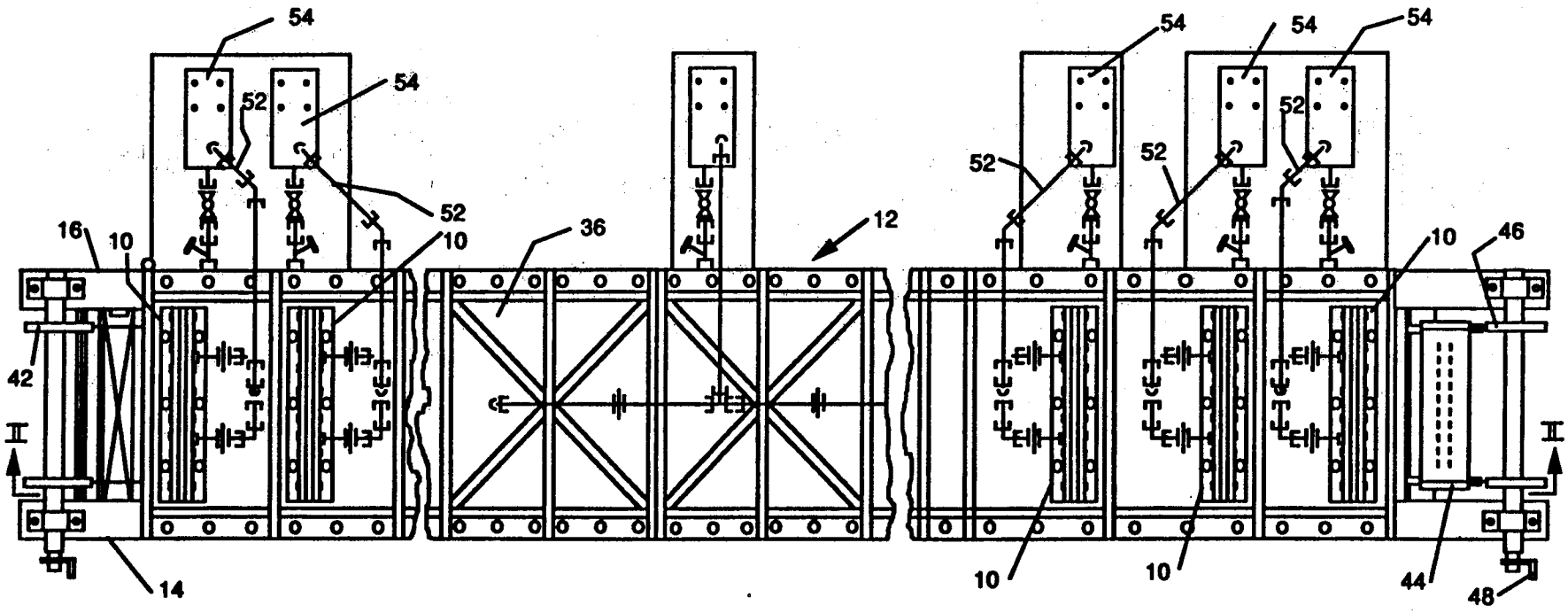
FIG. 1 is a plan view of a sealed strand fumeless pickling system of the type manufactured and sold by the assignee hereof and including five pressurized weirs according to the invention.
Figure 2:
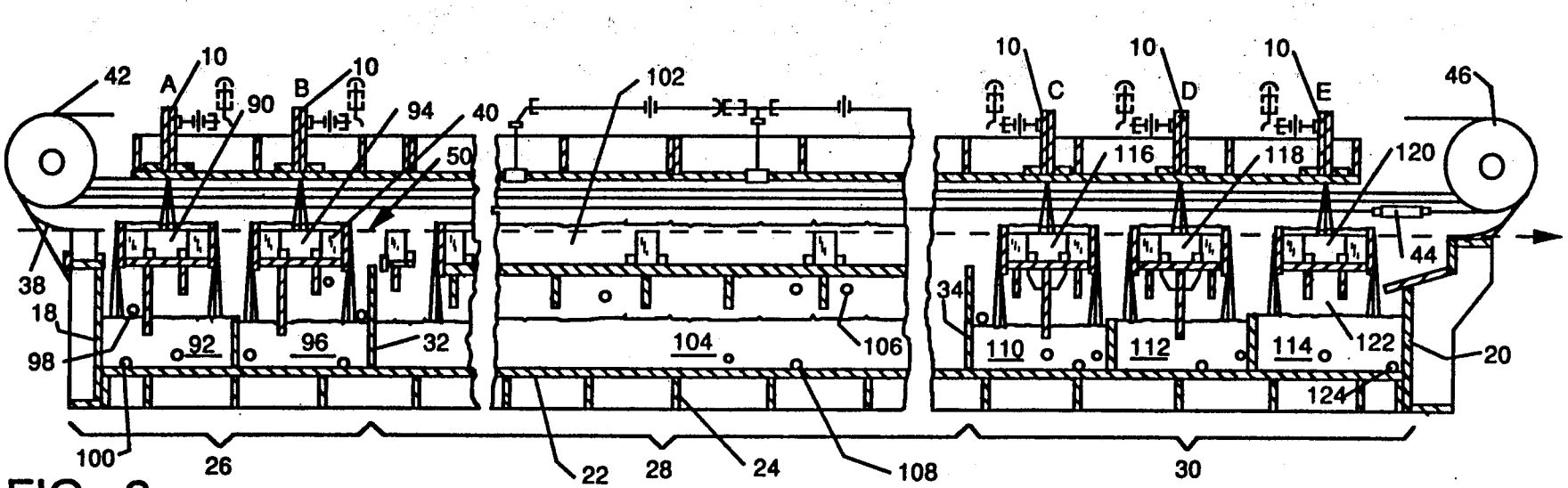
FIG. 2 is a sectional view taken along lines II—II of FIG. 1.
Figure 3:
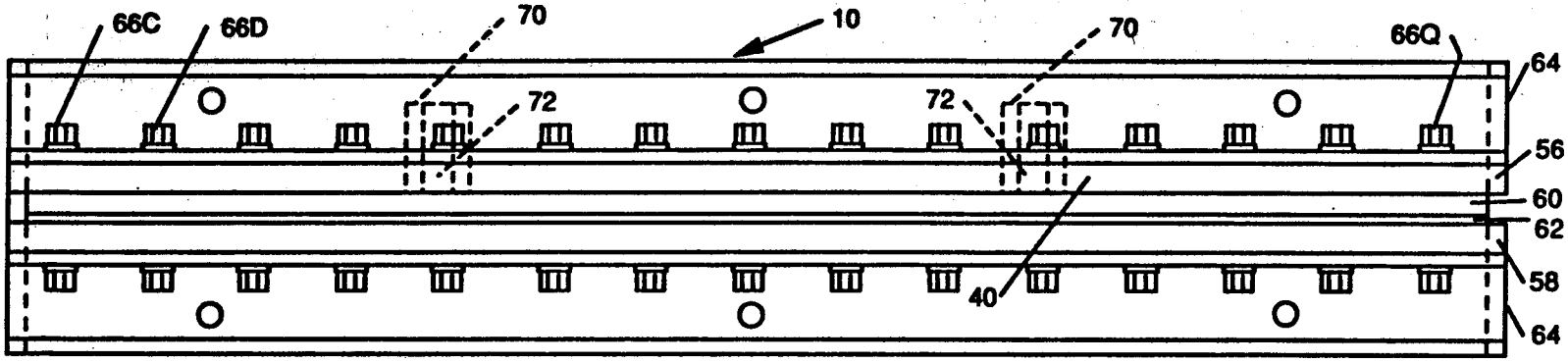
FIG. 3 is an enlarged top plan view of a pressurized weir for use in the system of FIG. 1 according to the invention.
Figure 4:
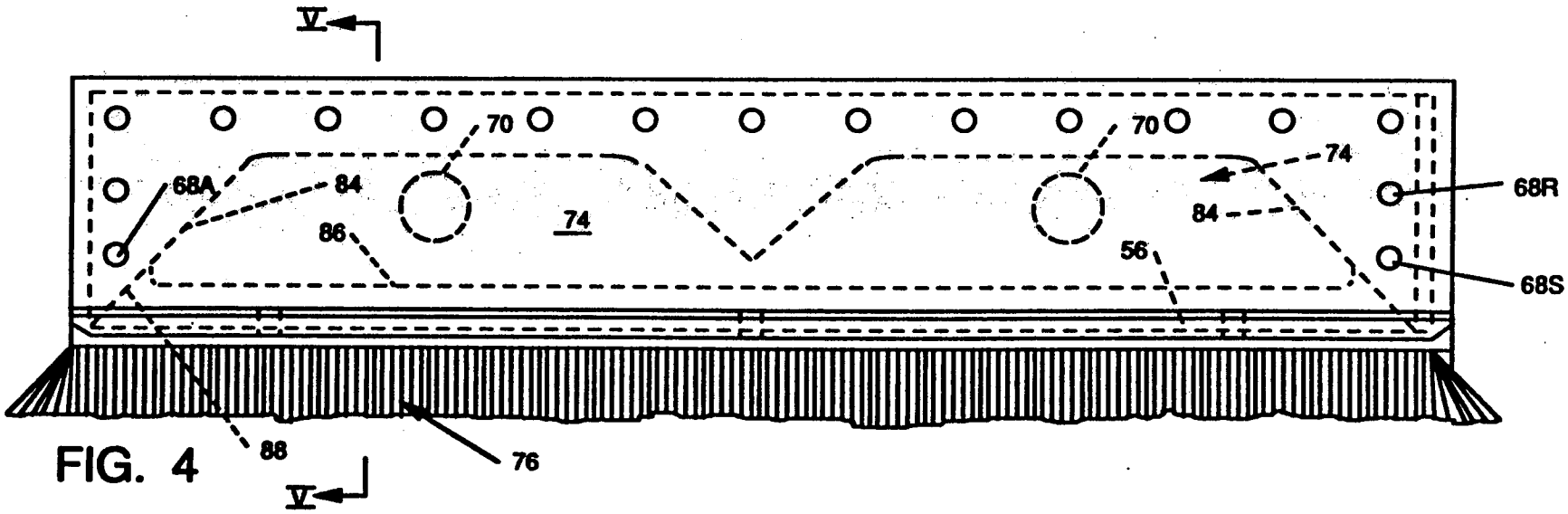
FIG. 4 is a side elevational view of the weir of FIG. 3.

The pressurized weir 10 according to the present invention is adapted to be used with or in a typical fumeless pickling or cleaning system, such as that shown in FIGS. 1 and 2, produced and sold by the assignee hereof. The system comprises an elongated, rectangular tank 12, preferably made of solid thermoplastic material such as polypropylene. A representative tank is approximately 5 feet wide and approximately 30 feet long. The tank 12 has two side walls 14, 16, two end walls 18, 20 and a base 22 which is supported by ribs 24. The tank 12 is divided into three compartments or cells, namely a quench section 26, a pickling section 28 and a rinse section 30 by partition walls 32 and 34 which extend from side wall 14 to side wall 16 of the tank 12. The quench section 26 and rinse section 30 are filled with water, whereas the pickling section 28 contains acid, such as hydrochloric or sulfuric acid. Each section includes a ribbed cover 36 or a single cover may extend over all three sections.

Strand wires 38 are initially threaded through the system over a series of granite weirs 40 using a pulley 42; the wires 38 are pulled through the quench section 26, pickling section 28 and rinse section 30 using a wire threading bobbin 44 and over a take-up pulley 46 by a power source, such as crank 48. The exact number of wires depends upon the size of the system. However, the pass line 50 of the wires 38 is shown in broken lines in FIG. 2 and the direction of travel is from left to right as shown by the arrowhead. Thereafter, the wires are connected into the rest of a line, such as a galvanizing line for coating. The end walls 18, 20 of the tank over which the wires 38 pass are normally open, so that fumes from the acid in the pickling section could otherwise escape to the environment.

To prevent the escape of toxic fumes, the pickling system shown in FIGS. 1 and 2 is provided with a plurality of pressurized weirs 10 according to the invention. Water is provided to each weir through inlet pipes 52 from a pressure source, such as a pump 54 (shown in schematic). In the system shown, there are five such weirs 10 extending across the tank from side wall 14 to side wall 16 at the locations identified as A, B, C, D and E. Since each weir 10 is identical, only one will be described in detail hereinafter. It will be apparent to those skilled in the art that either greater or fewer than five weirs may be used as long as there is at least one weir at each end of the tank 12.

As shown in FIGS. 3 through 7, each pressurized weir 10 comprises a pair of housing plates 56, 58, a reservoir plate 60 and a metering plate 62. The housing plates 56, 58 include support ribs 64 which are bolted to the cover 36 so that the housing plates extend vertically to the plane of the cover 36. The support ribs 64 also prevent bowing of the housing plates 56, 58. The reservoir plate 60 and the metering plate 62 are sandwiched between the housing plates 56, 58 and retained therebetween by fasteners, such as bolts 66A through 66S, which are inserted in holes 68A through 68S, respectively, in the housing plates 56, 58.

Figure 5:
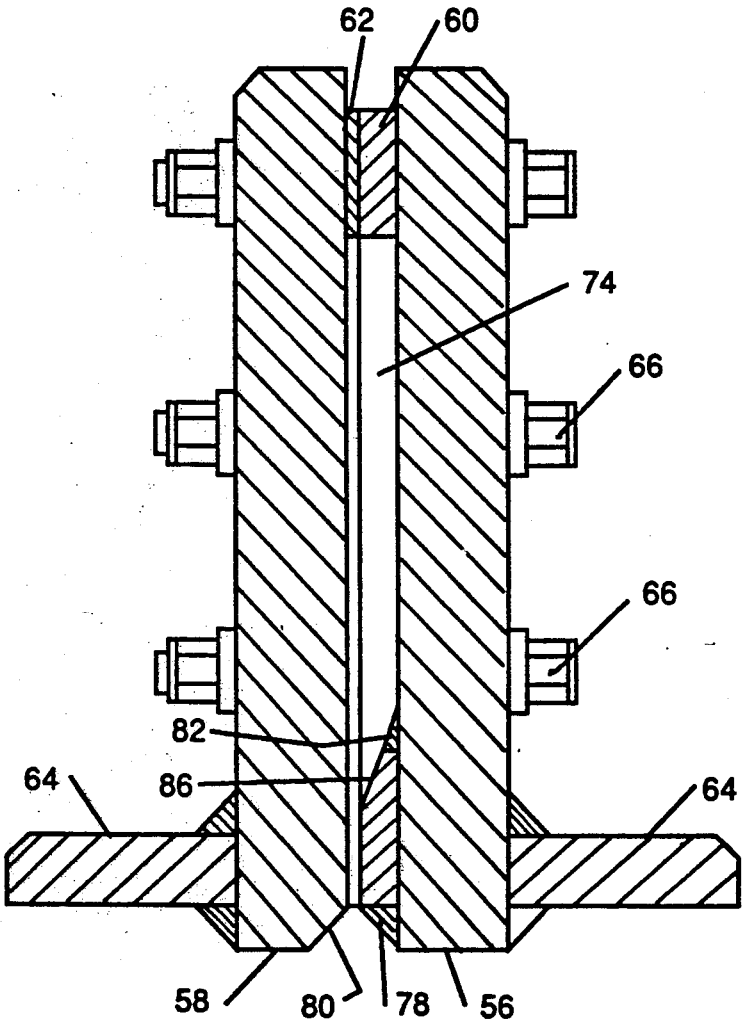
FIG. 5 is a cross-sectional view taken along lines V—V of the weir of FIG. 4.
Figure 6:
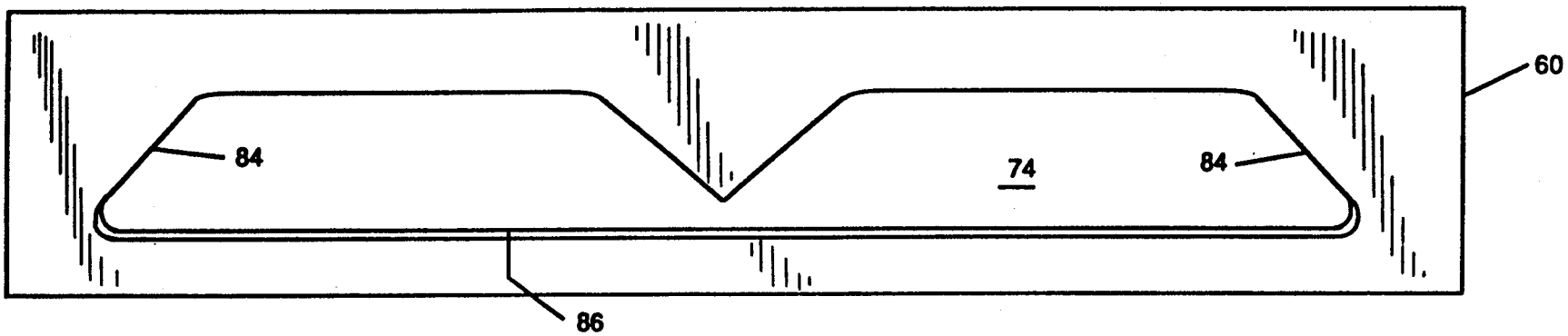
FIG. 6 is an elevational view of a reservoir plate for the weir of FIG. 3.
Figure 7:
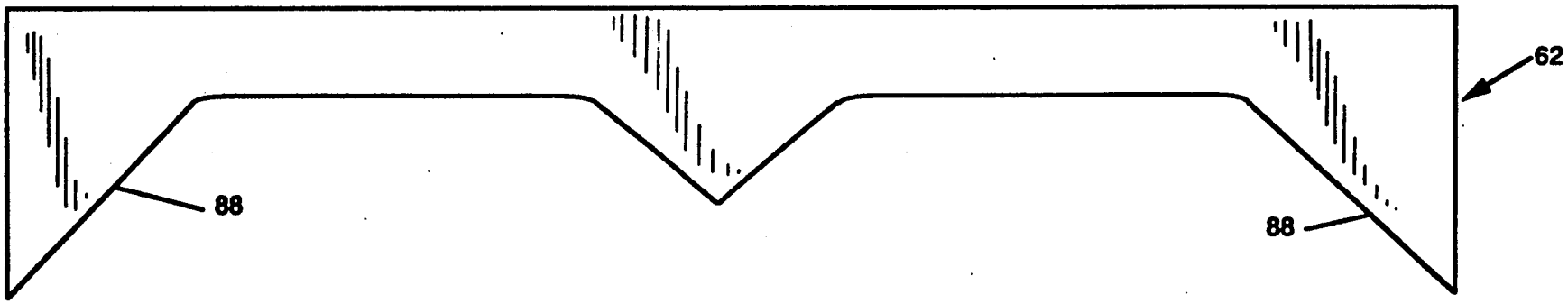
FIG. 7 is an elevational view of a metering plate for the weir of FIG. 3.

Inlet pipes 52 are connected to couplings 70 located at inlet openings 72 provided in housing plates 56 to permit water to be pumped, under pressure, through the housing plate inlet openings 72 into a reservoir 74 formed between the housing plates 56, 58 by the reservoir plate 60 and the metering plate 62. The pressurized water is exhausted from the bottom of the metering plate 62 to form a uniform water curtain 76 (as partially shown in FIG. 4). A fillet weld 78 along the edge of housing plate 56, a chamfer 80 along the inside edge of the housing plate 58 and a weld 82 between housing plate 56 and reservoir plate 60 (as shown in FIG. 5) facilitate flow of water in the water curtain 76.

The reservoir plate 60 contains at least one truncated triangular cutout or opening 84 which forms a part of the reservoir 74 of the weir 10. Two such openings 84 are shown in the reservoir plate 60 in FIG. 6, however, more can be used depending upon the length of the weir. The common lower edge 86 of the opening 84 is preferably routed to 30°. The balance of the reservoir 74 is formed by one or more in a series of truncated triangular openings 88 in metering plate 62, the bottom of which is open to permit water to pass from the reservoir 74 under pressure in the form of the water curtain 76. Two truncated triangular openings 88 are shown in the metering plate 62 in FIG. 7. Again, additional openings 88 corresponding to the openings in the reservoir plate 60 may be provided.

The thickness of the reservoir plate 60 and the metering plate 62 determines the thickness of the water curtain 76. The thickness of the metering plate 62, especially, is selected so as to provide the optimum reservoir size to reduce water turbulence and other water flow disturbances in the weir, to eliminate necking, to avoid undesirable gaps or bubbles in the continuous water curtain and to confine undesirable fumes in the tank. By choosing a metering plate 62 having an appropriate thickness, the thickness of the water curtain 76 can be adjusted appropriately to achieve these advantages. In a preferred embodiment, the thickness of the reservoir plate is ½" and the thickness of the metering plate is ⅛".

Referring again to FIGS. 1 and 2, there are two weirs 10 which extend from side to side of the tank 12 in the quench section 26 of the pickling system at locations A and B, respectively. The water curtain from weir 10 at location A empties through a slot in the cover 36 or through a space between sections of cover 36, as desired, into a water bath 90 which in turn overflows into tank section 92 below it. Similarly, the water curtain 76 from weir 10 at location B empties into water bath 94 which overflows into tank section 96 therebelow. The level of each water bath is maintained by recirculating water from the tank section below it. As the wires 38 move along the pass line 50, they pass through water baths 90 and 94 in which they are cleaned. When additional water is required in the water baths, it is provided by the water inlet 98 in tank section 92 which also can overflow into tank section 96. A drain 100 is also provided. From FIG. 2 it is evident that the water curtains 76 from the weirs 10 prevent fume emissions from escaping through the opening in the tank through which the wires enter.

After the wires leave the quench section 26, they pass through an acid bath 102 in the pickling section 28 of the tank 12. The acid is also recirculated from a tank section 104 to the bath 102. Acid can be added through acid inlet 106 or removed through drain 108 in the tank section 104.

When the wires complete their pass through the acid pickling section 28 of the system, they enter the rinse section 30. In the embodiment shown in FIGS. 1 and 2, the rinse section 30 is a typical counterflow rinse section comprising three tank sections 110, 112 and 114 at locations C, D and E. There is a water bath 116, 118 and 120 above the tank sections 110, 112 and 114, respectively.

The weirs 10 according to the invention extend across the tank 12 from side to side and are located above water baths 116, 118 and 120, respectively. The weirs 10 provide water curtains 76, which empty into the baths 116, 118 and 120. Water overflows each bath into its respective tank section below. As the wires 38 pass from one bath 116, to a second bath 118, to the third bath 120, more and more pickling acid is removed. Additional water can be provided to the tank sections 110 , 112 and 114 through a water inlet 122 in tank section 114 from which the water overflows in a countercurrent flow back into tank section 112 and then into tank section 110. A drain 124 is also provided.

From the foregoing, it is clear that the plurality of weirs 10 at locations C, D and E provide water curtains which prevent emissions of fumes from the end of the tank through which the wires exit.

The pressurized weir 10 according to the invention can be supplied with a pickling or cleaning tank, such as that shown in FIGS. 1 and 2. It may also be supplied separately and used to retrofit an existing tank in existing pickling or cleaning systems.

Having described presently preferred embodiments of the invention, it is understood that it may otherwise be embodied within the scope of the appended claims.

I claim:

1. In combination with a pickling or cleaning system including a closed cell tank having opposed ends, at least two cells for water and a cell therebetween for acid and wherein the ends of the tank are normally open to the atmosphere, the improvement in means for containing fumes from the acid within the tank comprising at least one pressurized weir in each cell for water, each weir comprising:

a pair of housing plates, one plate having an inlet opening for admitting water under pressure to the weir;

a reservoir plate and a metering plate;

means for retaining said reservoir plate and said metering plate between said housing plates;

a reservoir provided by said reservoir plate and said metering plate for receiving water under pressure from said inlet opening;

at least one truncated triangular opening in each of said reservoir plate and said metering plate, the bottom of said opening permitting water under pressure to be exhausted from said reservoir in the form of a water curtain.

2. The improvement in a pressurized weir as set forth in claim 11 wherein the reservoir plate and the metering plate include a plurality of truncated triangular openings.

3. The improvement in a pressurized weir as set forth in claim 2 wherein said plates are made of a solid thermoplastic material.

4. The improvement in a pressurized weir as set forth in claim 3 wherein said solid thermoplastic material is polypropylene.

5. The improvement in a pressurized weir as set forth in claim 1 wherein said plates are made of a solid thermoplastic material.

6. The improvement in a pressurized weir as set forth in claim 5 wherein said solid thermoplastic material is polypropylene.

7. The improvement in a pressurized weir as set forth in claim 6 wherein said retaining means comprises a plurality of fasteners.

8. The improvement in a pressurized weir as set forth in claim 5 wherein said retaining means comprises a plurality of fasteners.

9. The improvement in a pressurized weir as set forth in claim 1 wherein said retaining means comprises a plurality of fasteners.

10. The improvement in a pressurized weir as set forth in claim 1 and including a plurality of weirs in each cell for water.

11. The improvement in a pressurized weir as set forth in claim 10 and including two weirs in one cell for water which comprises a quench section of the tank and three weirs in a second cell for water which comprises a rinse section of the tank.

* * * * *

UNITED STATES PATENT AND TRADEMARK OFFICE

CERTIFICATE OF CORRECTION

PATENT NO. : 5,195,547

DATED : March 23, 1993

INVENTOR(S) : Daniel R. Devens

It is certified that error appears in the above-identified patent and that said Letters Patent is hereby corrected as shown below:

Column 4 Line 44 "110 ," should read --110,--.

Claim 2 Line 16 Column 5 "11" should read --1--.

Claim 3 Line 20 Column 5 "2" should read --1--.

Claim 5 Line 2 Column 6 "1" should read --2--.

Claim 7 Line 8 Column 6 "6" should read --3--.

Claim 8 Line 11 Column 6 "5" should read --4--.

Signed and Sealed this

Eighth Day of February, 1994

Bruce Lehman

*Attest:*

BRUCE LEHMAN

*Attesting Officer*

*Commissioner of Patents and Trademarks*